United States Patent [19]

Tunell

[11] Patent Number: 4,572,307

[45] Date of Patent: Feb. 25, 1986

[54] ROCK DRILL

[75] Inventor: Lars-Erik Tunell, Sandviken, Sweden

[73] Assignee: Santrade Limited, Luzerne, Switzerland

[21] Appl. No.: 591,783

[22] Filed: Mar. 21, 1984

[30] Foreign Application Priority Data

Apr. 5, 1983 [SE] Sweden ..... 8301860

[51] Int. Cl.[4] ..... E21B 10/56

[52] U.S. Cl. ..... 175/410; 175/417

[58] Field of Search ..... 175/417, 410, 414, 415, 175/389, 418, 419, 400, 390

[56] References Cited

U.S. PATENT DOCUMENTS

| | | | |
|---|---|---|---|
| 2,689,109 | 9/1954 | Curtis | 175/417 |
| 2,725,216 | 11/1955 | Brown | 175/417 |
| 3,997,011 | 12/1976 | Staroba | 175/400 |
| 4,296,825 | 10/1981 | Larsson | 175/410 |
| 4,304,312 | 12/1981 | Larsson | 175/400 |

FOREIGN PATENT DOCUMENTS

| | | | |
|---|---|---|---|
| 121891 | 6/1948 | Sweden | 175/410 |
| 273312 | 5/1971 | U.S.S.R. | 175/418 |
| 607972 | 5/1978 | U.S.S.R. | 175/410 |

*Primary Examiner*—Stephen J. Novosad
*Assistant Examiner*—Hoang C. Dang
*Attorney, Agent, or Firm*—Burns, Doane, Swecker & Mathis

[57] ABSTRACT

A rock drill for percussion drilling comprises frontal and gauge button inserts, said frontal button inserts being parallel with the longitudinal axis of the rock drill and said gauge button inserts being inclined at an angle relative to said longitudinal axis and arranged to define the diameter of the hole drilled by the rock drill. The number of the frontal button inserts is two and the number of gauge button inserts is two.

7 Claims, 5 Drawing Figures

ROCK DRILL

The present invention relates to a rock drill for percussion drilling of small holes comprising a bit body which includes a front face. Frontal and gauge button inserts, preferably of hard metal, project from the front face. The gauge button inserts are inclined at an angle relative to the longitudinal axis of the rock drill and are arranged to define the diameter of the hole drilled by the rock drill.

The purpose of the invention is to provide a rock drill of the above-mentioned type, which makes it possible to drill holes smaller than those obtainable by hitherto known button bits.

The above and other objects of the invention have been attained by giving the invention the characterizing features stated in the appending claims.

The invention is described in detail in the following with reference to the accompanying drawings in which one embodiment is shown by way of example. It is to be understood that this embodiment is only illustrative of the invention and that various modifications thereof may be made within the scope of the claims.

In the drawings, FIG. 1 shows a side view of a rock drill according to the invention.

Figure 1:
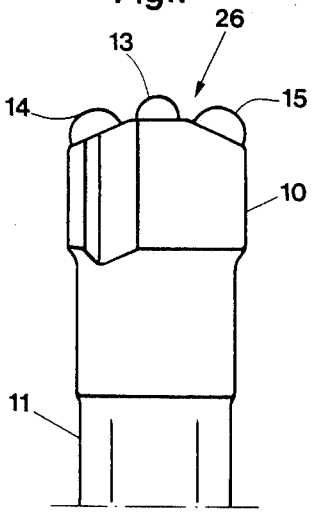
Figure 4:
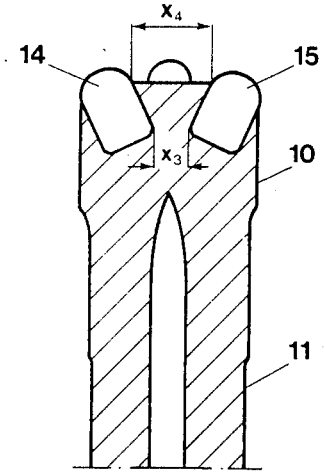
FIG. 4 shows a longitudinal section taken on the line IV—IV in FIG. 3.
Figure 2:
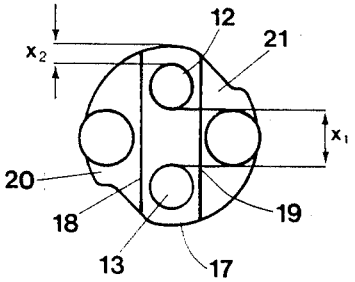
FIGS. 2 and 3 show a front view of the rock drill in FIG. 1.
Figure 5:
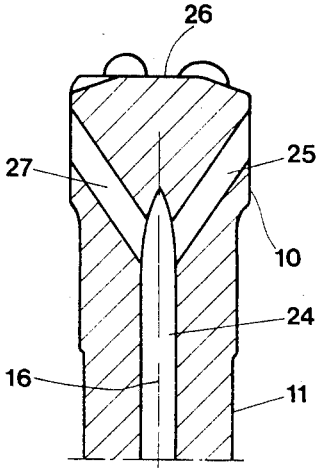
FIG. 5 shows a longitudinal section taken on the line V—V in FIG. 3.

The rock drill shown in the figures comprises a bit body 10, which forms part of an integral drill steel 11. The bit body 10 includes a front face 26, which extends generally transversely relative to the longitudinal axis 16 of the rock drill. Hard metal inserts 12,13 are in a manner known per se mounted on a planar portion 17 of the front face 26; said planar portion being perpendicular to the longitudinal axis 16 and formed with mutually parallel long sides 18,19. The inserts 12,13 are substantially parallel with the longitudinal axis 16. In similarity, two hard metal inserts 14,15 are in a manner known per se mounted on inclined sections 20,21 of the front face; said inclined sections being inclined relative to the planar section 17. The gauge or peripheral buttons 14,15 are inclined at an angle relative to the longitudinal axis 16, thereby being arranged to define the diameter of the hole drilled by the rock drill.

According to the invention the number of frontal inserts 12,13 is two. Further, the distance $x_1$ between the inserts 12,13 is larger than the difference $x_2$ between the radial extension of the front face 26 and the radial extension of the frontal buttons 12,13. The distance $x_1$ is defined as the projected distance between opposed side surfaces of the inserts 12,13. The difference in extension $x_2$ is defined as the projected distance between the radially outer side surfaces of the frontal inserts 12,13 and the radially outer side surfaces of the gauge buttons 14,15 upon an imaginary rotation of the inserts 14,15 to a plane traversing the inserts 12,13 so as to superimpose the insets 12,13,14,15 upon each other.

According to a preferred embodiment of the invention also the number of gauge buttons 14,15 is two. In the preferred embodiment of the smallest distance $x_3$ between the radially innermost portions of the gauge inserts-receiving bores in the front face 26 is smaller than the distance $x_1$.

Further, the smallest distance $x_4$ between the upper portions of the gauge insert-receiving bores in the front face 26 is larger than the distance $x_1$.

Primarily, the invention is intended to be applied in rock drills having an outer diameter within the interval 25 mm to 35 mm. In a preferred embodiment the diameter of the gauge buttons 14,15 is larger than the diameter of the frontal buttons 12,13. Typically, in a rock drill having an outer diameter of 28 mm the diameters of the gauge and frontal button inserts, respectively, suitably are 9 mm and 8 mm, respectively.

The inserts 12,13,14 and 15 are symmetrically disposed about the longitudinal axis 16 so that an imaginary line interconnecting the centres of the gauge button inserts 14,15 is perpendicular to an imaginary line interconnecting the centres of the frontal button inserts 12,13; said imaginary lines intersecting each other at their middle points.

Figure 3:
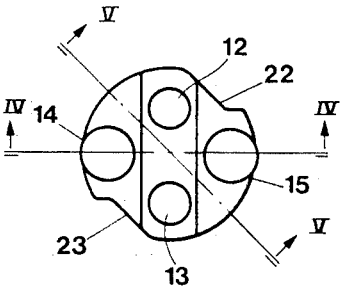

As shown in FIG. 3 the bit body 10 includes two diametrically opposed recesses 22,23 in connection with the front surface 26. The drill dust produced during drilling is transported from the bottom of the bore hole rearwards therethrough via the recesses 22,23. In the preferred embodiment the recesses 22,23 bridge the one end of the long sides 18,19 of the planar portion 17.

The rock drill is provided with a central flushing passage 24 for conducting flushing medium to the bottom of the drill hole, said central flushing passage communicating with sidewards directed passages 25,27. The passages 25,27 are arranged to terminate between the recesses 22,23 in the peripheral surface portions of the bit body behind the front face 26.

In the illustrated embodiment the invention is applied on an integral drill steel. The invention might, however, be applied also on detachable drill bits, either bits where the bit body is provided with a rear threaded portion intended to be connected to a drill rod provided with corresponding threads or conbits, i.e. bits where the bit body is provided with a rear portion having a tapered surface intended to be connected to a drill rod provided with a correspondingly tapered portion.

I claim:

1. A rock drill for percussion drilling of small diameter holes, comprising:

a bit body including a front face, frontal button inserts, consisting of two in number and formed of hard metal, are mounted in said bit body and projecting forwardly beyond said front surface, and gauge button inserts, consisting of two in number and formed of hard metal, are mounted in gauge bores in said bit body and projecting forwardly beyond said front face, said gauge bores and said gauge button inserts being inclined at an angle relative to a longitudinal axis of the rock drill as viewed in a radial direction such that said gauge bores approach one another rearwardly, said gauge button inserts being arranged to define the diameter of the hole drilled by the rock drill, said frontal button inserts spaced radially inwardly of the diameter of the hole being drilled, the distance between said frontal button inserts being larger than the difference between the radial extension of said front face and the radial extension of said frontal button inserts, respectively, the smallest distance between the radially innermost portions of said gauge bores being smaller than said distance between said frontal button inserts, the smallest distance between the longitudinally outermost portions of said gauge bores being larger than said distance between said frontal button inserts, said frontal button inserts arranged on planar surface portions of said front face, said planar surface portions being coplanar, said gauge button inserts arranged on first and second surface portions, respectively, of said front face in such a way that a first imaginary line interconnecting the centers of the gauge button inserts is perpendicular to a second imaginary line interconnecting the centers of the frontal button inserts, said first and second surface portions being inclined relative to said planar surface portions, and said first and second imaginary lines intersecting each other at their middle points.

2. A rock drill according to claim 1, wherein the frontal button inserts are substantially parallel with the longitudinal axis of the rock drill.

3. A rock drill according to claim 1, wherein the diameter of the gauge button inserts is larger than the diameter of the frontal button inserts.

4. A rock drill according to claim 1, wherein the bit body is provided with two substantially diametrically opposed recesses in connection with the front face for purposes of facilitating removal of drill dust, said recesses bridging the one end of the long sides of the planar surface portion.

5. A rock drill according to claim 4, wherein a sidewards directed passages communicating with a central flushing passage is adapted to terminate between said recesses behind the front face.

6. A rock drill according to claim 1, wherein said frontal inserts project forwardly beyond said gauge button inserts.

7. A rock drill according to claim 1, wherein said surface portions are formed by a single planar surface portion of said front face, said single planar surface portion having substantially mutually parallel long sides.

* * * * *